US006943326B2

(12) United States Patent
Hirst

(10) Patent No.: US 6,943,326 B2
(45) Date of Patent: Sep. 13, 2005

(54) CIRCUIT FOR CONTROLLING A FUSING SYSTEM

(75) Inventor: Mark Hirst, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 60 days.

(21) Appl. No.: 10/687,758

(22) Filed: Oct. 20, 2003

(65) Prior Publication Data

US 2005/0082276 A1 Apr. 21, 2005

(51) Int. Cl.[7] ..... H05B 1/02; H05B 3/02

(52) U.S. Cl. ..... 219/492; 219/216; 219/497; 219/507

(58) Field of Search ..... 219/216, 482, 219/486, 488, 490, 492, 494, 497–499, 501, 509, 510, 507, 517; 399/13, 33, 49, 69, 74, 320, 328, 330, 67, 88; 323/236, 239, 241, 266, 290, 300, 319, 225

(56) References Cited

U.S. PATENT DOCUMENTS

| | | | | |
|---|---|---|---|---|
| 4,663,569 A | | 5/1987 | Alley et al. | |
| 4,928,055 A | | 5/1990 | Kaieda et al. | |
| 5,119,132 A | * | 6/1992 | Butler | 399/49 |
| 5,204,723 A | | 4/1993 | Hanada et al. | |
| 5,483,149 A | | 1/1996 | Barrett | |
| 5,789,723 A | | 8/1998 | Hirst | |
| 5,811,764 A | | 9/1998 | Hirst | |
| 5,925,278 A | | 7/1999 | Hirst | |
| 6,018,151 A | | 1/2000 | Hirst | |
| 6,229,120 B1 | * | 5/2001 | Jewell | 219/486 |
| 6,246,034 B1 | | 6/2001 | Glaser et al. | |
| 6,317,571 B1 | * | 11/2001 | Adams | 399/67 |
| 6,542,705 B2 | | 4/2003 | Fujita et al. | |
| 6,833,691 B2 | * | 12/2004 | Chapuis | 323/283 |

OTHER PUBLICATIONS

K.A. Nigim et al., "Power quality improvement using integral–PWM control in an AC/AC voltage converter", Electric Power Systems Research 63 (2002) pp. 65–71.

R. Ramshaw, Part 4 of Extra Material for use with, "PSpice® Simulation of Power Electronics Circuits", ECE Dept. University of Waterloo, published by Chapman & Hall, 1997, 11 pgs.

* cited by examiner

*Primary Examiner*—Tu Hoang

(57) ABSTRACT

In an embodiment of the invention, a circuit for controlling a fusing system such as used in a printer, copier or the like, comprises a timing circuit; an averaging circuit which receives an output from the timing circuit and averages the signal to produce a voltage signal; a modulation circuit arrangement which receives the voltage signal from the averaging circuit and generates a train of pulses which varies with the voltage signal from the averaging circuit; and a switch driver circuit which is responsive to the pulse train from the modulation circuit and which drives a power supply switching circuit with a timing to apply a smoothly changing alternating current to the fusing system. The modulation circuit may be of the pulse width modulation type or the frequency modulation type.

24 Claims, 11 Drawing Sheets

CIRCUIT FOR CONTROLLING A FUSING SYSTEM

BACKGROUND OF THE INVENTION

Dry electrophotographic copiers and printers develop an image utilizing a dry toner. The typical toner is composed of styrene acrylic resin, a pigment-typically carbon black, and a charge control dye to endow the toner with the desired tribocharging properties for developing a latent electrostatic image. Styrene acrylic resin is a thermo-plastic which can be melted and fused to the desired medium, typically paper.

The typical fusing system in an electrophotographic printer or copier is composed of two heated platen rollers which, when print media with a developed image pass between them, melt the toner and through pressure physically fuse the molten thermal plastic to the medium. Heating is usually accomplished by placing one or more high power tungsten filament quartz lamps inside the hollow platen roller.

These types of printers or copiers, however, tend to suffer from phenomenon know as "flicker." Flicker is measured by the proposed European regulatory document IEC 61000-3-3, and is the impression of unsteadiness of visual sensation induced by a light stimulus whose luminance or spectral distribution fluctuates with time. In electrical power distribution systems, flicker is the result of large current changes reacting with the power distribution system impedance causing voltage fluctuations. These voltage fluctuations, in the form of voltage sags and surges, cause the light output of incandescent lamps to fluctuate and can cause fluorescent lamps to drop out. Flicker in incandescent lamps is easily noticed because photonic emissions for incandescent lamps is a nonlinear function of the voltage source and any voltage deviation causes a much larger deviation in the luminescent intensity of the light emitted from the incandescent lamp. Light flicker is visually irritating and also represents unwanted harmonics and power transients being placed on a power system.

Many printer and copiers on the market today are based on what shall be referred to as "triac control". In order to better understand this so called "triac control", reference is made to FIG. 1 which shows in block diagram form the arrangement of the basic type of triac controlled arrangement.

As shown in FIG. 1, an AC voltage source is connected to a fuser resistor which generates heat, by way of a triac. The triac is controlled by a circuit (viz., a microprocessor) that implements a power control algorithm via which the phase angle of the triac ($\phi$) is determined based on inputs from a zero cross detection circuit, a circuit which monitors the phase angle of the AC current being fed to the fuser, a temperature set point circuit, and a temperature sensor signal indicative of the temperature of the fuser. The inputs from the temperature set point circuit and the temperature indicative signal from the fuser are monitored via suitable control routines and when the temperature of the fuser of the fusing system exceeds the set point temperature, the gate signal (which takes the form of a narrow pulse whose duty ratio, d, is less than 1%), is stopped.

As will be understood, the current flow through the triac which is initiated by the narrow gate pulse, extinguishes when the current flow, which passes therethrough as a result of the gate opening pulse, falls below a minimum holding current which is necessary to keep the triac conducting.

The power p(d) which is delivered is given by:

$$p(d) := \frac{1}{\pi} \cdot \frac{V^2}{R} \cdot \left(d \cdot \frac{\pi}{2} - \frac{1}{2} \cdot \sin(d \cdot \pi) \cdot \cos(d \cdot \pi)\right)$$

wherein:

V:=peak AC voltage;

d:=duty ratio (the fraction of the half cycle for which the triac conducts); and R:=resistance in ohms.

However, it should be noted that the AC current which is drawn by the above described type of phase controlled triac is rich in harmonics.

BRIEF DESCRIPTION OF THE DRAWINGS

The various features and advantages of the embodiments of the present invention will become more apparent as a description thereof is given with reference to the appended drawings wherein.

DETAILED DESCRIPTION OF EXEMPLARY EMBODIMENTS

For a dry electrophotographic fusing system to operate worldwide it must be able to operate satisfactorily on AC power systems providing from 90 Vrms to 240 Vrms at frequencies of 50 Hz to 60 Hz. The fusing system must heat up from ambient room temperature to operating temperature as quickly as possible while exhibiting extremely low flicker as its power consumption level changes. The fusing system, when combined with the balance of the electro-photographic printer power electronics, must meet International Electrical Commission (IEC) regulations IEC 61000-3-2 and IEC 61000-3-3 for current harmonics and flicker. The printer must pass Federal Communications Commission (FCC) class B regulations for power line conducted emissions and radiated emissions.

As noted above, fusers in many printers/copiers in use today employ what shall be referred to generically as a "triac control". That is to say, the fusing systems are supplied with alternating current through a power switching circuit arrangement which includes a triac. However, in order to change the control behavior of an actual triac it is necessary to revise the firmware in the microprocessor arrangement which receives the data inputs from a zero cross detection circuit and a temperature sensor arrangement and processes this data to produce the narrow gate pulse signal which is used to render the triac conductive.

The above-mentioned type of control, however, demands that if a change in the gate signal is required, a change in the firmware of the microprocessor is also necessary. In order to implement changes in the fuser control while avoiding the need to revise the existing microprocessor firmware and to enable the same basic hardware to be used without major modification thereto, it is proposed, in accordance with the embodiments of the invention, to eliminate the triac and replace it with a flicker attenuating circuit arrangement which can be inserted into the system either as a modular unit or as a relative minor modification to an existing monolithic system.

Figure 1:
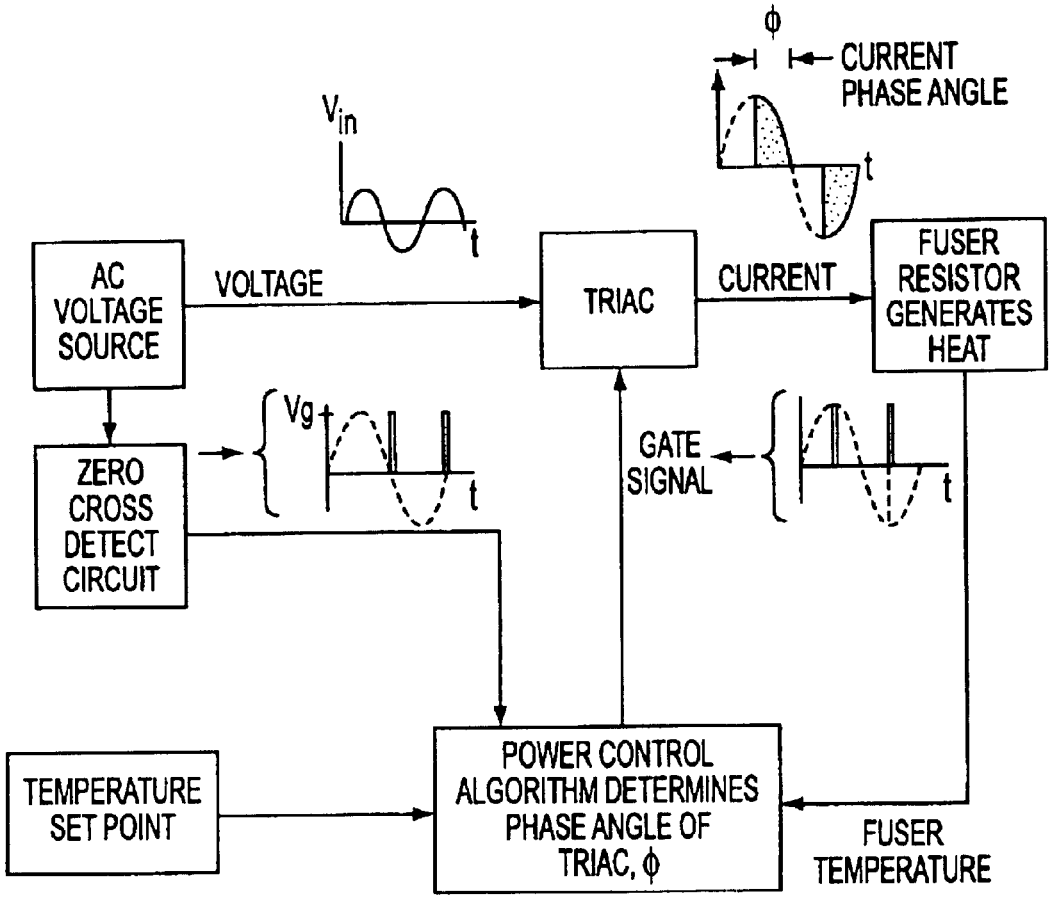
FIG. 1 (PRIOR ART)
FIG. 1 is a block diagram schematically depicting a triac fuser control arrangement according to the prior art.
Figure 2:
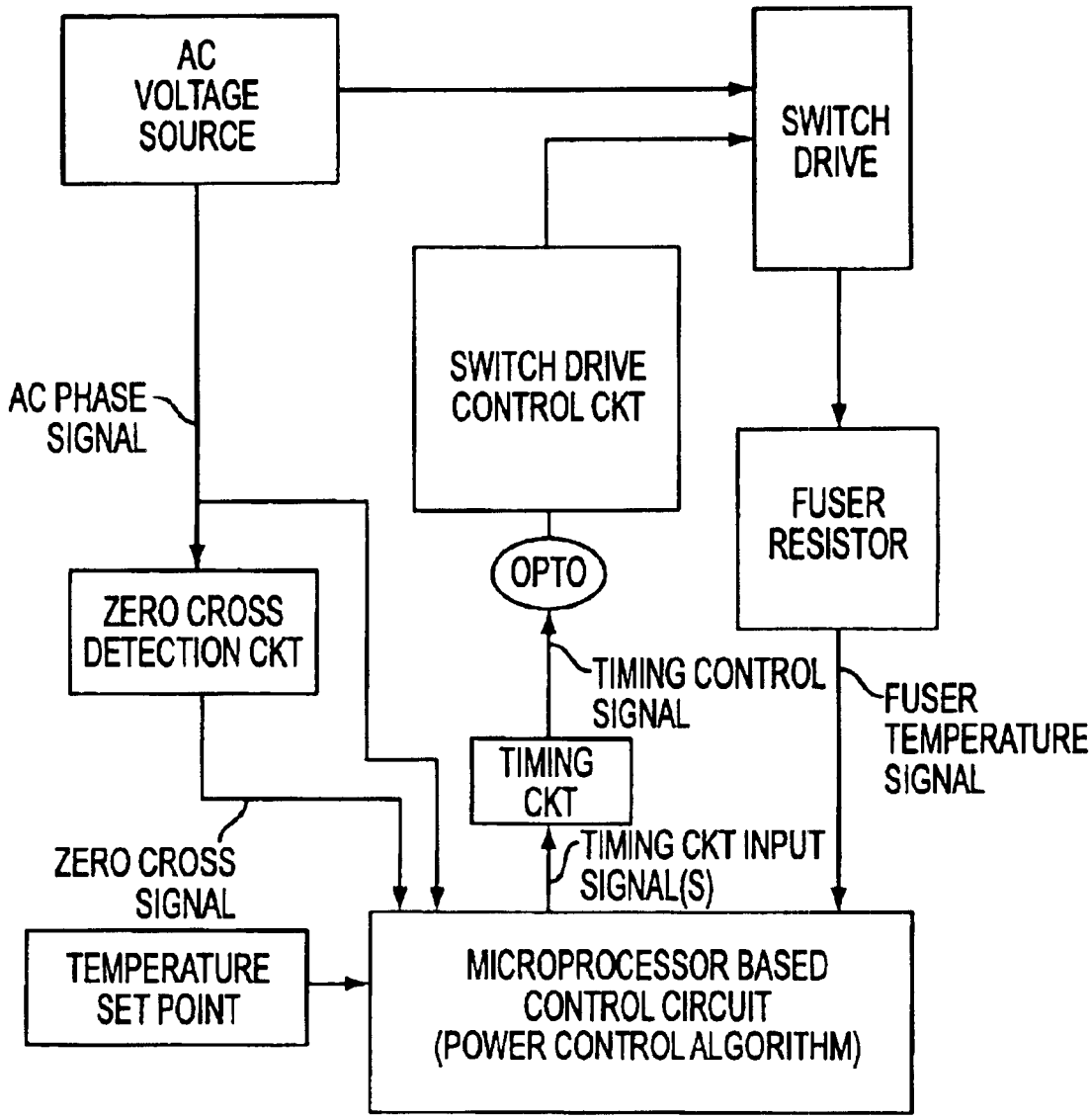
FIG. 2 is schematic block diagram showing an arrangement in which the embodiments of the invention can be incorporated.
Figure 3:
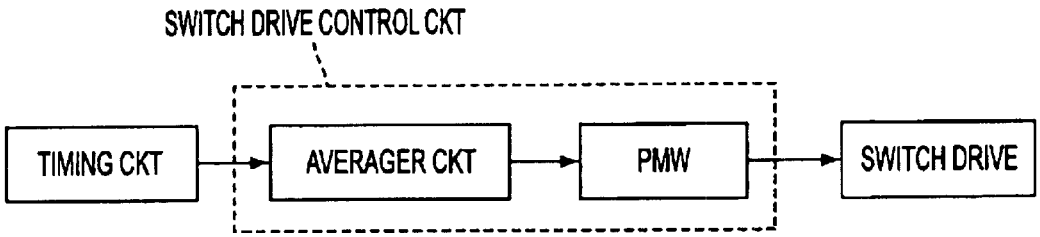
FIG. 3 is a block diagram showing a first circuit embodiment according to the present invention.
Figure 4:
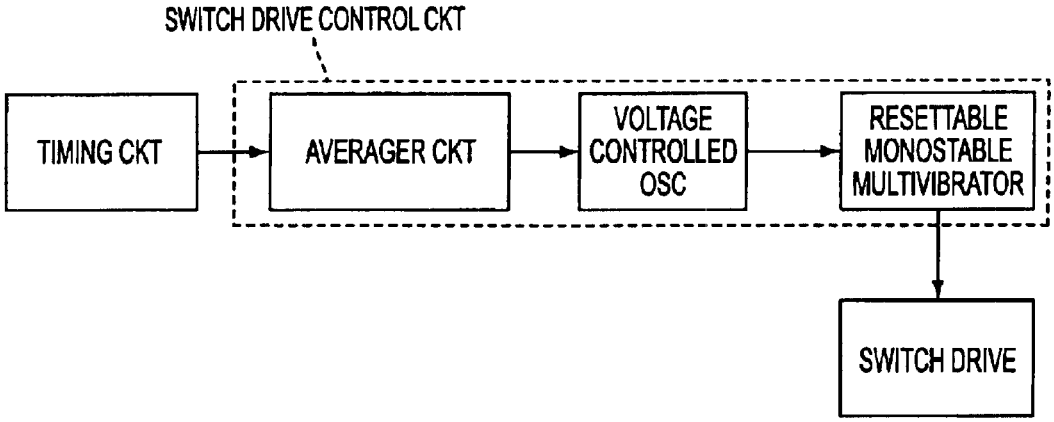
FIG. 4 is a block diagram showing a second circuit embodiment according to the present invention.
Figure 5:
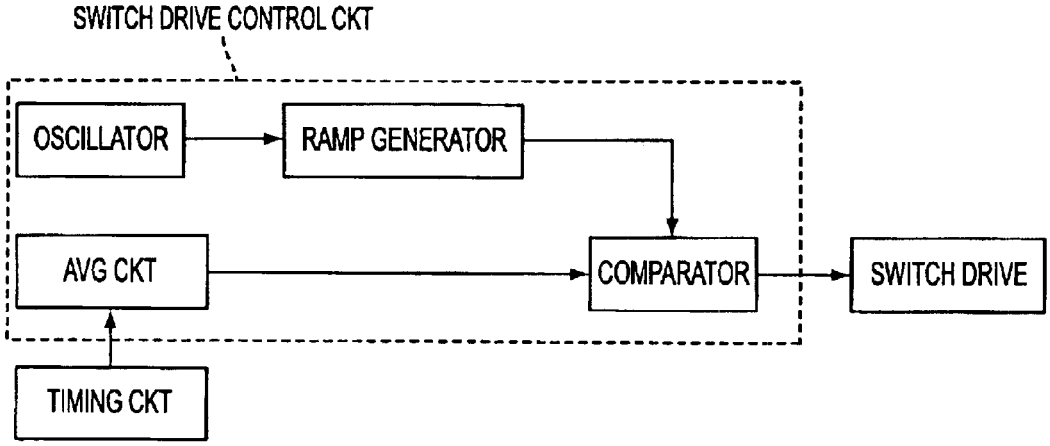
FIG. 5 is a block diagram showing a third circuit embodiment according to the invention.

More specifically, it is proposed to replace triac circuit with a circuit arrangement of the nature shown in FIG. 2 wherein the flicker attenuating circuit arrangement basically comprises a timing circuit; a switch drive control circuit and a switch drive. As will become more apparent hereinlater as a discussion of the embodiments of the invention which are schematically depicted in FIGS. 3–5, unfolds, the timing circuit can, depending on the embodiment, be connected to or actually be the microprocessor based control circuit which runs under the control of a power control algorithm and which is responsive to a zero cross signal and temperature set point signal indicative of the temperature which the fuser is to be controlled, a signal indicative of the temperature of the fuser, and a signal indicative of the phase of the AC which is output by the AC voltage source. These signals and/or others which are available in currently marketed copiers/printers, are used as input signals either directly or indirectly to initiate/control the output of the timing circuits of the embodiments of the invention.

FIG. 2, should be only taken as a schematic depiction of the manner in which the embodiments of the invention can be disposed in the fusing system of a dry EP copier or printer, and should not be taken as limiting the disclosed embodiments or the manner in which they can be actually be introduced into a copier/printer.

The outputs of the timing circuits are subjected to an averaging in a manner which attenuates flicker control and are transmitted through an electrically isolating arrangement such as an optical isolator (designated "opto" in FIG. 2). The reason for this electrical isolation will become clear hereinlater.

In the embodiments of the invention, timing circuits which are based on either phase angle control, integral half wave control or hysteresis control, are used.

Timing Circuits

1) Phase Angle Based Timing Control

Figure 6A:
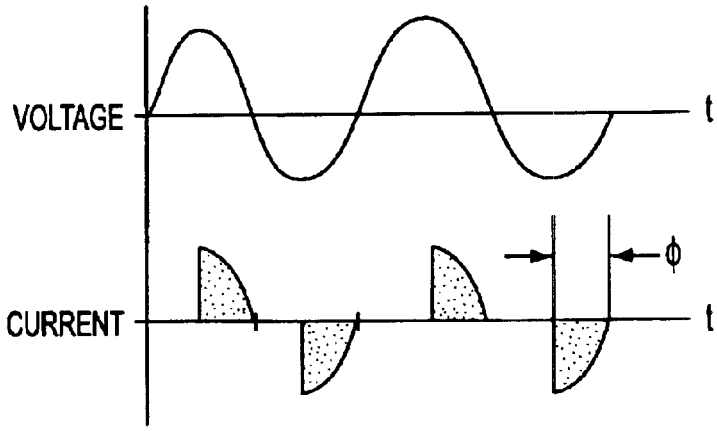
FIGS. 6A–6C are graphical representations of the basis on which timing circuits, which form part of the circuits shown in FIGS. 3–5, operate.

In connection with the timing circuit which is based on phase angle control, it will be appreciated from FIG. 6A that the control implemented is basically similar to that provided by a triac type circuit. That is, a control wherein, if the pulses which are output by the timing circuit were used to switch current on and off would result in a conduction which is designated "triac conduction". That is, a current flow which is initiated by the narrow gate signal and which continues until being extinguished at a zero cross of the AC voltage.

Figure 7:
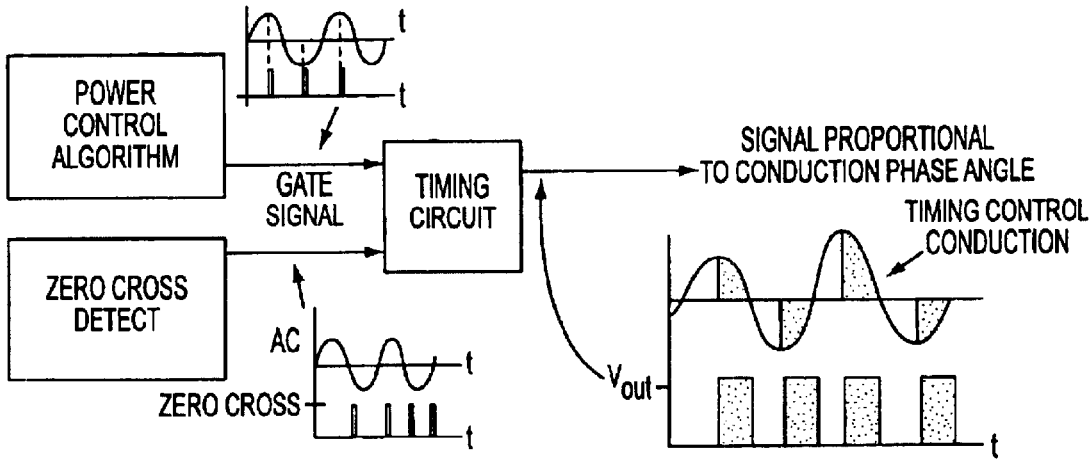
FIG. 7 is a block diagram schematically depicting a circuit arrangement of a first timing circuit arrangement which can be used with the circuit arrangements shown in FIGS. 3–5.

In accordance with the phase control which is implemented by the phase angle controlled timing aspect of one embodiment of the invention, the timing circuit, such as schematically shown in FIG. 7 is provided. This circuit is responsive to a gate signal and a zero cross detection pulse signal which are available from the hardware which is conventionally provided in the triac controlled printers to which the embodiments of the invention are used to modify.

This timing circuit produces a pulse train output (Vout) that can be used in place of a "triac" gate command and wherein the pulse width is exactly proportional to the conduction phase angle. The output of the timing circuit shown in FIG. 7, can be supplied to any one of the switch drive control circuits which are shown in block diagram form in FIGS. 3–5.

Figure 8:
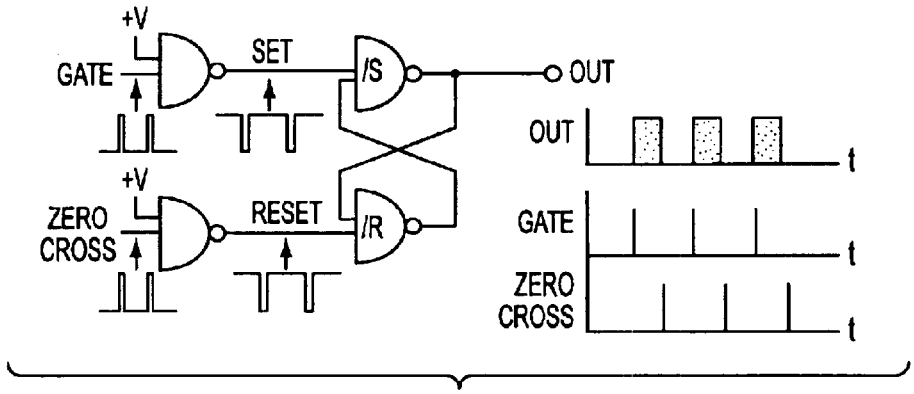
FIG. 8 is a specific circuit arrangement which constitutes a first embodiment of the timing circuit shown in FIG. 7.

FIG. 8 shows a first example of a circuit which can be used as the timing circuit shown in FIG. 7. In this example, a set/reset (S/R) flip flop circuit is produced using two cross coupled NAND logic gates and two NAND logic gates configured as inverters which are circuited together in the illustrated manner.

The gate signal is applied to the input of the upper inverter while the zero cross signal is applied to the lower inverter. The resulting set and reset pulses are applied to the upper and lower NANDs and produce the output shown. The resulting output is a train of pulses with the illustrated timing.

Figure 6B:
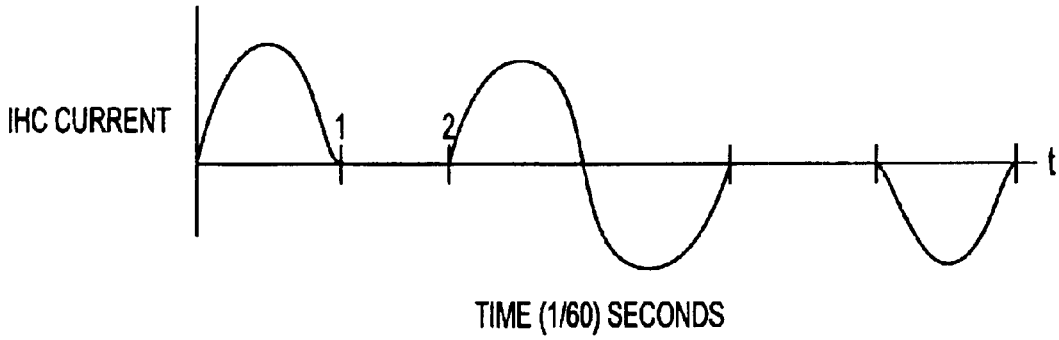
Figure 9:
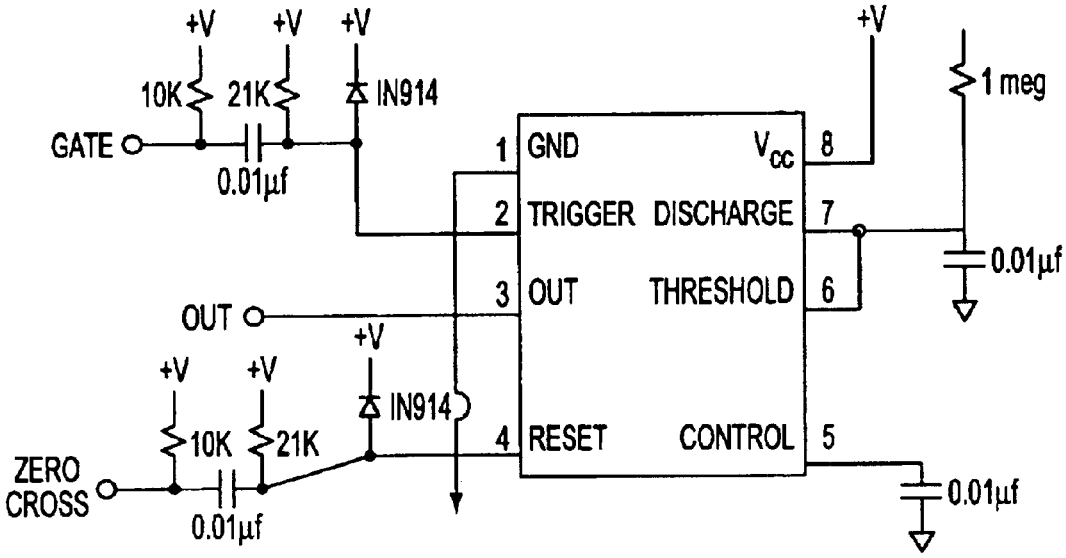
FIG. 9 a specific circuit arrangement which constitutes a second embodiment of the timing circuit shown in FIG. 7.

FIG. 9 shows a second example of a circuit arrangement which can be used as the timing circuit shown in FIG. 6. In this arrangement, a monostable circuit such as a NE555N (available from American Microsemiconductor Inc.) is used. In this arrangement, the gate signal and the zero cross signals are applied to the trigger and Reset terminals of the mono-stable circuit. This produces an output which is the same as the V-out train of pulses (output of the timing circuit) shown in FIG. 7.

In accordance with this phase angle control aspect of the invention, the output of the timing circuits of either of FIGS. 8 and 9, can be supplied to an averaging circuit of any of the switch drive control circuits shown in FIGS. 3–5.

Figures 10A, 10B:
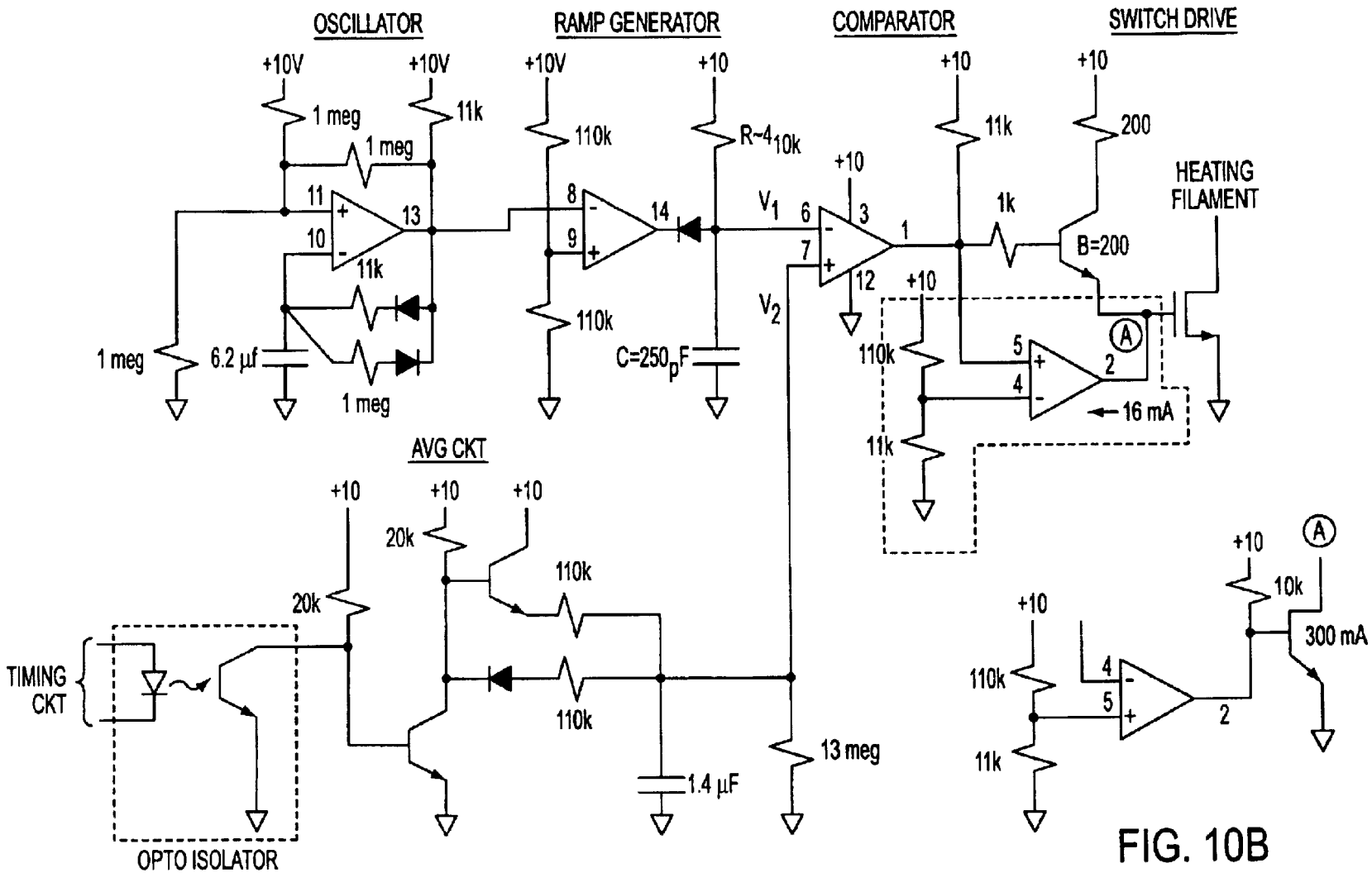
FIG. 10A is a circuit diagram showing a specific example of the circuit arrangement which constitutes the circuits depicted in block diagram form in FIG. 5.
FIG. 10B is a circuit diagram showing an alternative arrangement of part of the circuit arrangement shown in FIG. 9A but which exhibits a higher drive capacity to turn a drive transistor "off" faster.

By way of example, the timing outputs of the circuits shown in FIGS. 8 and 9 can be applied to the circuit arrangement shown in FIG. 10A or the alternative version thereof wherein the circuit portion enclosed in broken line is replaced with that depicted in FIG. 10B. As will be readily appreciated, the circuit arrangement shown in FIG. 10A is that which is depicted in block diagram form in FIG. 5. The circuit arrangement shown in FIG. 10B when incorporated in the circuit shown in FIG. 10A is capable of a higher drive capability to turn the drive transistor "off" faster.

It is, however, important to note that the timing circuits according to the embodiments of the invention should be optically isolated from the high voltage circuitry which they control. As shown in FIG. 10A an opto-isolator is interposed between the timing circuits and the averaging circuit of the switch drive control circuit, to prevent damage to the components which are designed to operate at low voltages (5–10 volts) as different from those adapted for voltages on the order of 110–220v.

Figure 11:
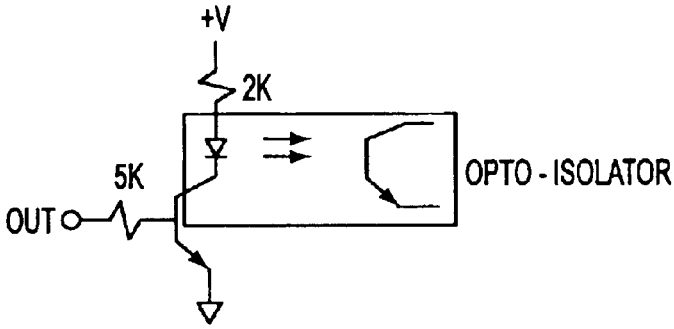
FIG. 11 is a schematic representation of an opto-isolator which can be used between the timing and averaging circuits in each of the circuit arrangements shown in FIGS. 3–5.

FIG. 11 shows an example of an opto isolator which can be used in any of the embodiments of the invention which are disclosed herein. This opto isolator can, by way of example, take the form of a "Sharp PC-123" available from Sharp Microelectronics of the Americas.

The outputs (OUT) of the circuits shown in FIGS. 8 and 9 can be connected to the terminal (OUT) shown in FIG. 10 and, as noted above, applied to the circuit arrangement shown in FIG. 10A (for example). In this case, the circuits of FIGS. 8 and 9 would be connected through the opto isolator to the averaging circuit shown in FIG. 10A.

2) Integral Half Cycle Based Timing Control

FIG. 5B conceptually shows the basis of the integral half cycle control (IHC) aspect of the invention. As depicted, the timing control is based on a mixture of full and half-waves.

The control enabled by this mode of control allows power to be supplied to heat the fuser in increments suited for use with systems having a lower thermal mass wherein the temperature of the rollers rises rapidly and would tend to become overheated if the supply of power to the fuser were to be continued for longer periods. This arrangement is suited for use in the European market, for example, in that it does not produce current harmonics. It does however, tend to generate flicker as it creates sub-harmonics in the 8 Hz–12 Hz range where human flicker perception is greatest.

Figure 12:
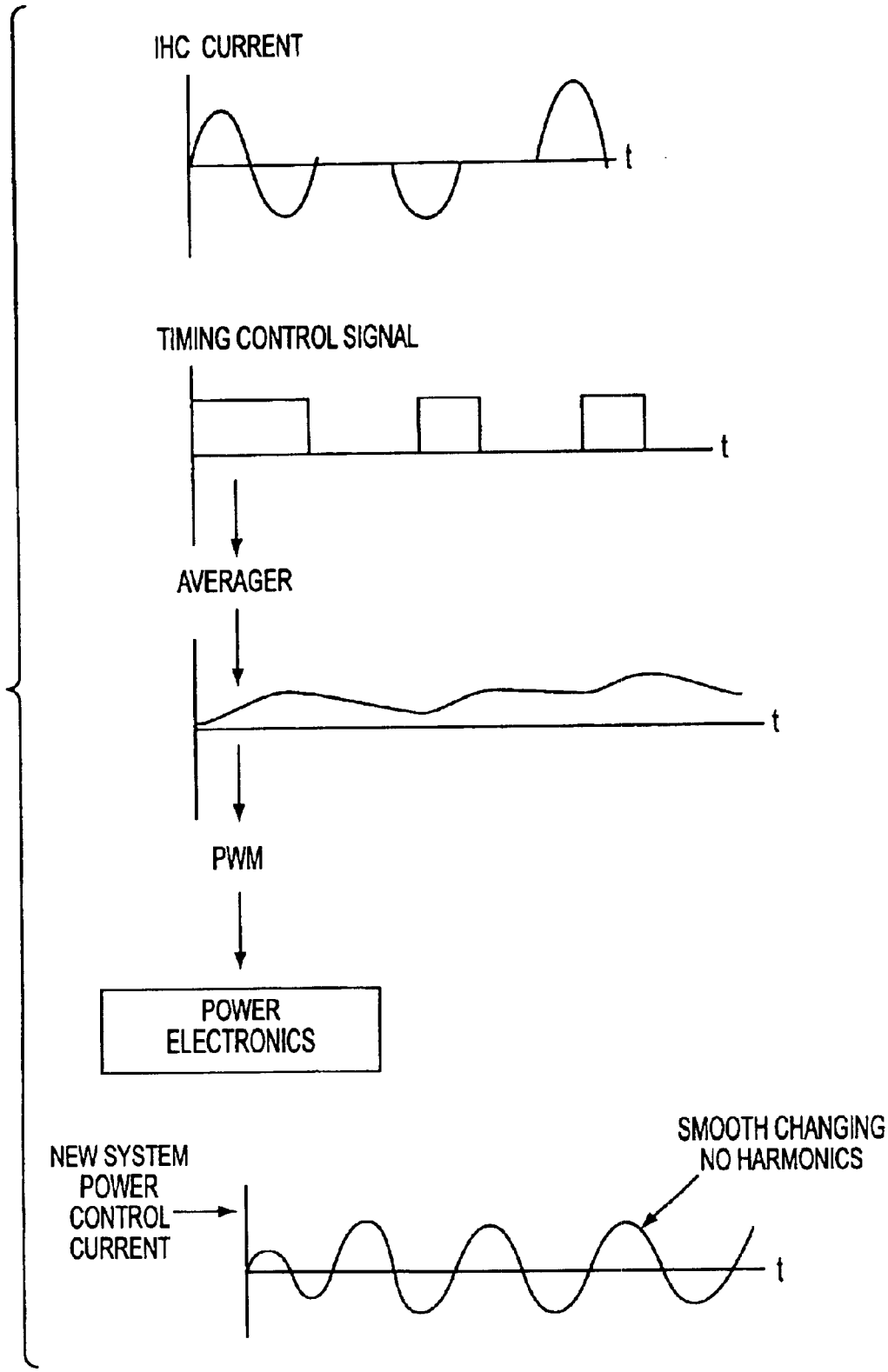
FIG. 12 depicts the overall control concept according to the control implemented using a integral half cycle based timing circuit.

FIG. 12 graphically depicts the control features which underlie the integral half cycle control (IHC) embodiment of the invention. In this embodiment the timing circuit can comprise a microprocessor which is part of the printer control to be programmed to produce an IHC (Integral Half Cycle) circuit function, wherein a pulse width corresponds to a full wave of the alternating current is produced and followed by two shorter pulses which correspond to two half waves of the current. Alternatively, the timing circuit in accordance with this control can take the form of a hard-wired counter arrangement which will produce the pulse train which is labeled "timing" command.

Inasmuch as the circuits which would enable this IHC control to be carried out are well within the purview of a person skilled in the art of copier/printer control, no further description will be given for brevity.

The averaging circuit which receives the command pulses from the timing circuit produces a smoothed output which is then supplied to a pulse width modulator (PWM). The pulse train output from the PWM is used to control a circuit arrangement which is shown schematically as "power electronics" which supplies the fuser with AC current which varies smoothly and which is free of harmonics. An example of such "power electronics" is, of course, provided in FIG. 10A in connection with the circuit labeled "switch drive".

Figure 13:
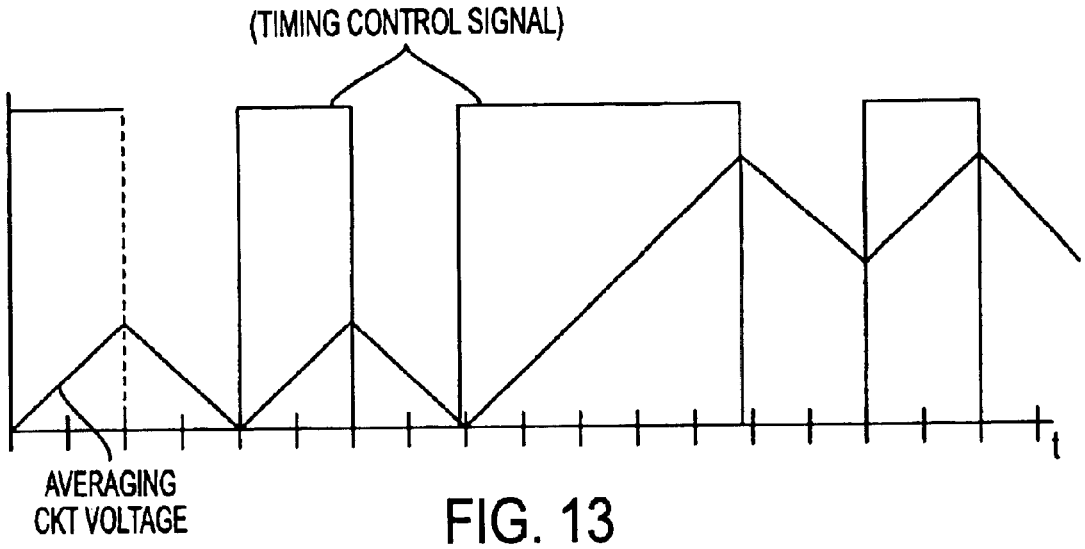
FIG. 13 is a graph depicting the manner in which the averaging circuits used in the circuit arrangements shown in FIGS. 3–5 can operate to smooth the voltage output therefrom.

The effect of the averaging circuit and its effect in the embodiments of the invention will be appreciated from FIG. 13. As shown, the voltage rises (ramps up) during each pulse and then lowers between pulses. The greater the pulse width the longer the time that is available for the voltage to rise. In that the period which elapses between a trailing edge of one pulse and the rising edge of the next pulse is, in this example, fixed, the voltage which has developed during a long pulse does not fall to its original level before an on state being re-established and the voltage being enabled to rise again.

By feeding this averaged signal to a PWM circuit it is possible to produce a smoothly varying current which markedly lowers flicker.

3) Hysteresis Based Timing Control

Figure 6C:
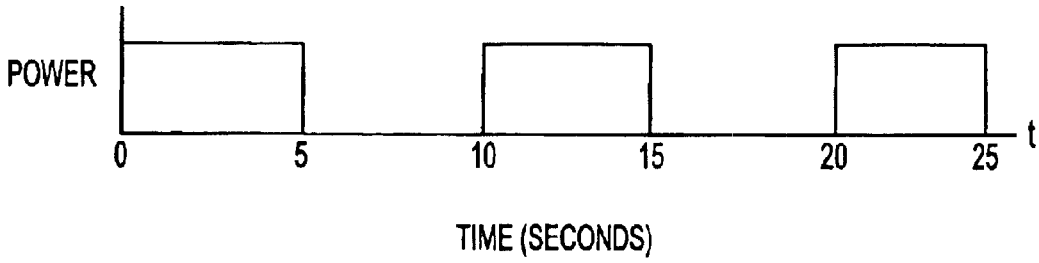

FIG. 6C conceptually shows the basis of the hysteresis control aspect of the invention. As depicted, the timing control is such that current is supplied alternatively on/off to the fuser for a relatively long duration on the order of 1–5 seconds (for example only). This control, however, tends to be suitable for systems having a large thermal mass and which are such as to heat-up and cool-down relatively slowly.

The hysteresis control which is implemented in accordance with this facet of the invention is basically similar to that implemented via the integral half cycle control (IHC) and differs in that the width of the pulses which are produced by the microprocessor are longer and essentially uniform in length.

Figure 14:
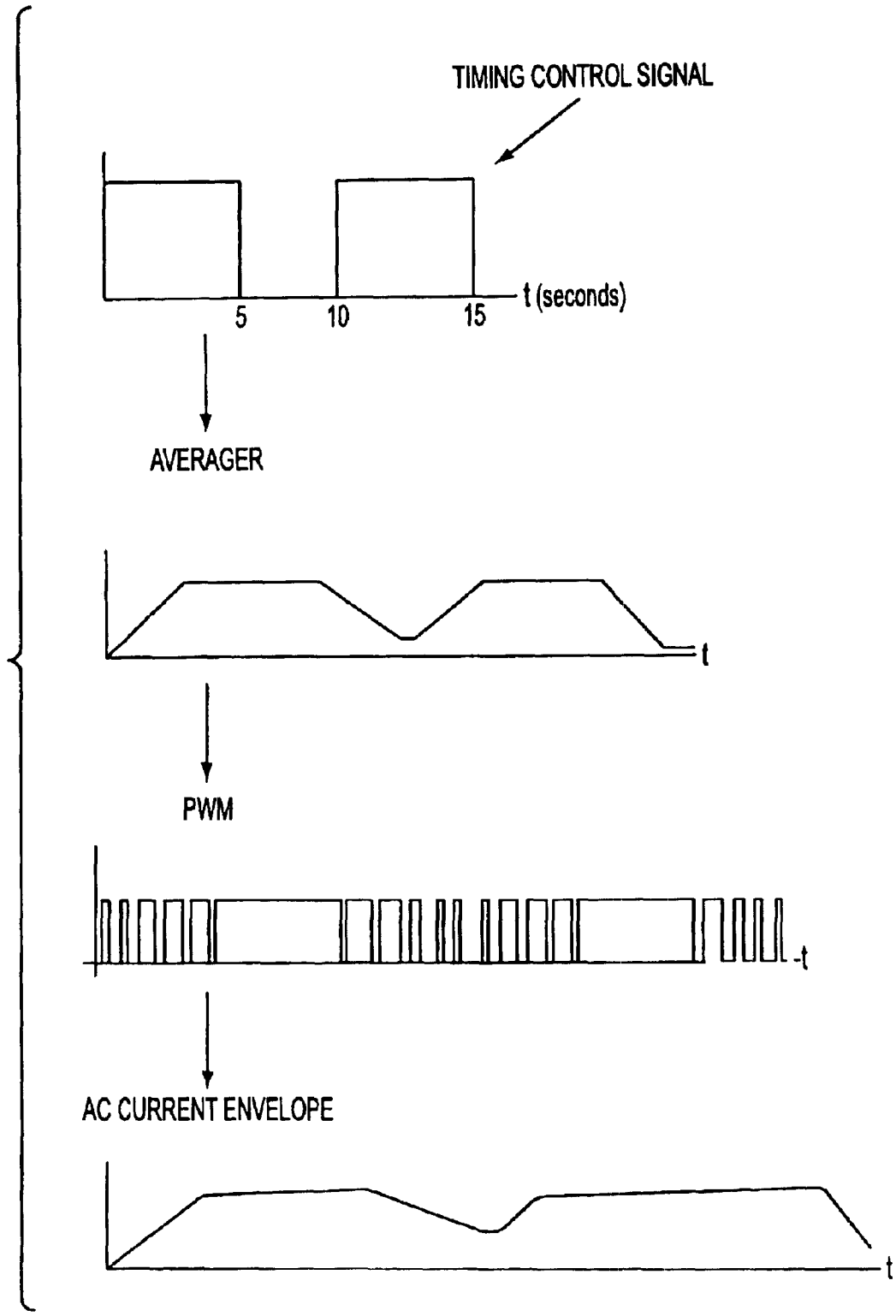
FIG. 14 depicts a control implemented using a hysteresis based timing circuit.

FIG. 14 shows in graphical form, the effect of averaging on the timing circuit output (viz., the output of the microprocessor). The square wave form of the timing circuit signal which results from the IHC timing, is averaged to produce a waveform wherein the voltage rises over a period of time before reaching a peak value. When the control pulse stops, the voltage is allowed to decrease at a given rate and therefore produces the truncated saw tooth wave form illustrated.

The averaging signal is then fed to a PWM which outputs a train of variable width pulses in the manner illustrated which results in a smooth AC current envelope of the nature illustrated. Flicker is attenuated by the smoothed/gradual build-up and decrease from the maximum voltage which is maintained therebetween by the averaging circuit.

Circuit Arrangements

The above-described timing circuits, that is the phase angle control, the integral half cycle and the hysteresis type timing circuits, can each be used with any one of the three circuit arrangements which are depicted in FIGS. 3–5.

Figure 15A:
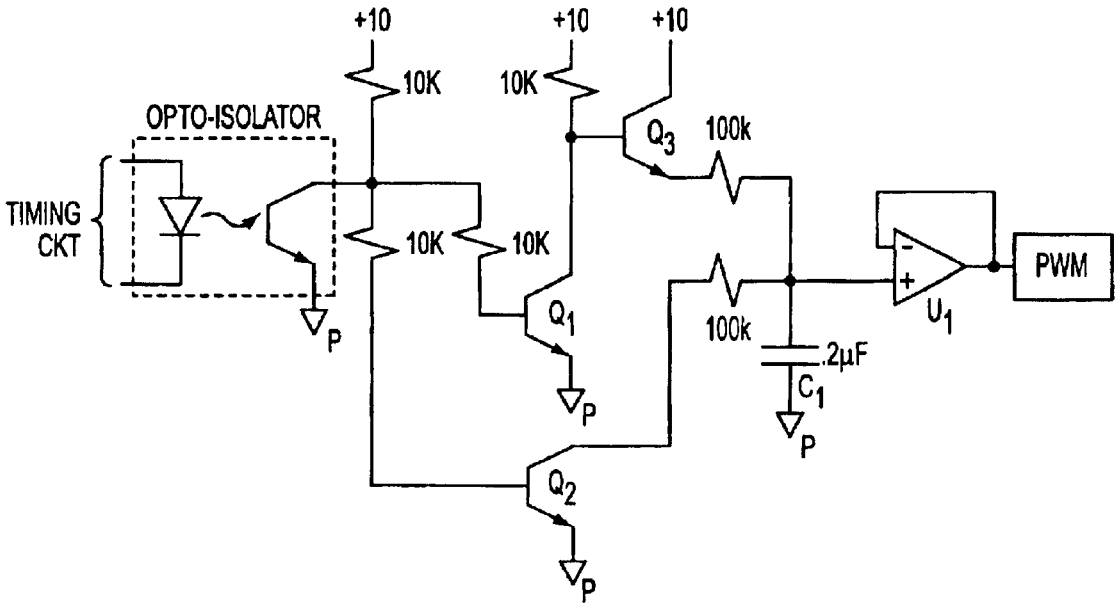
FIGS. 15A and 15B show examples of specific circuit arrangements which can be used in the circuit arrangement depicted in block diagram form in FIG. 3.
Figure 15B:
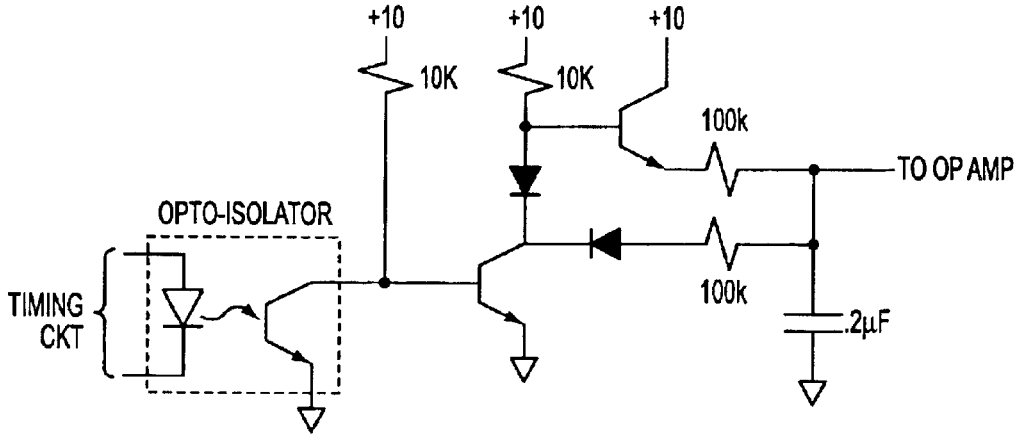

An example of a circuit arrangement which can be used as that shown in block diagram form in FIG. 3 is depicted in FIG. 15A. As will be noted, an opto-isolator is interposed between the averaging circuit and the timing circuit. The averaging circuit in this arrangement is connected to a PWM circuit through an operational amplifier $U_1$. The alternative arrangement which is shown in FIG. 15B is adapted to be connected to the operational amplifier $U_1$. In this circuit the PWM circuit constitutes a frequency modulation section.

The circuit arrangement which is shown in FIG. 5, is, as discussed above, shown in detail in FIG. 10A. As will be appreciated the oscillator, ramp generator and comparator, constitute an analog pulse width modulator circuit arrangement. It will also be noted that the various values which are associated with the resistors, capacitors etc., are merely exemplary of those which can be used and should in no way be taken as limiting the scope of the illustrated circuit which, when taken as a whole, is itself merely exemplary of one possible electronic configuration that can be used to implement the oscillator, ramp generator, comparator, averaging and switch drive circuit functions.

The circuit arrangement shown in block diagram form in FIG. 4 replaces the PWM in FIG. 3 between the averaging circuit and the switch drive circuit (viz., the pulse width modulation section) with a voltage controlled oscillator which is adapted to receive the voltage output of the averaging circuit and a resetable mono-stable multivibrator which is interposed between the voltage controlled oscillator and the switch drive circuit. The operation of this circuit is such as to turn the circuit which supplies current to the heating filament on and off in a manner comparable with that which is achieved by the PWM circuit shown in FIG. 3.

The resetable monostable multivibrator in this embodiment is arranged to have a minimum conduction time so that the frequency of the output of the voltage controlled oscillator signal linearly controls the amount of current which is supplied to the filament of the fuser.

The output of the voltage controlled oscillator is a frequency that varies linearly with the output voltage of the averaging circuit. The output of the resettable monostable multivibrator is a square wave of fixed 'on' time whose frequency varies linearly with the output of the voltage controlled oscillator. This circuit arrangement is analogous to a pulse width modulator with variable frequency rather than variable pulse width. The end result is a power transfer characteristic that varies linearly with the output of the averaging circuit.

SUMMARY

The circuit arrangements which have been disclosed achieve the desired goal of attenuated flicker. They are backward compatible with engine controllers and the Integral Half Cycle (IHC), phase control, or hysteresis control that the engine controllers utilize to control the power delivered to the fusing system. Circuits are disclosed which limit the maximum duty cycle of the IHC controller and provides a universal fusing system which can be used with any 50–60 Hz 90–240 VAC low voltage public power distribution system. The embodiments produce good power quality over the entire range of fuser power from 10–1000 watts, producing no harmonic currents and minimal subharmonics currents.

For further disclosure relating to the above type of fusing system control, reference may be had to U.S. Pat. No. 5,483,149 issued in the name of Barret on Jan. 9, 1996; U.S. Pat. No. 5,789,723 issued in the name of Hirst on Aug. 4, 1998; U.S. Pat. No. 5,925,278 issued on Jul. 20, 1999 in the name of Hirst; U.S. Pat. No. 5,811,764 issued on Sep. 22, 1998; and U.S. Pat. No. 6,018,151 issued on Jan. 25, 2000 in the name of Hirst.

It will be understood that while the invention has been described with reference to only a limited number of embodiments, the concepts which are imparted by this disclosure will enable a person of skill in the art of printer/copier control, to devise various circuit arrangements which will enable a triac based circuit to be replaced with simple circuits which will attenuate flicker and at the same time enable the printer/copiers to be adapted to either U.S. or European markets. The scope of the present invention is limited only by the claims which are appended hereto.

What is claimed is:

1. A circuit for controlling a fusing system, comprising:

a timing circuit which, in response to at least one input, is configured to produce a timing control signal;

an averaging circuit configured to receive the timing control signal from the timing circuit and to average the signal to produce an averaged signal;

a frequency modulation circuit configured to receive the averaged signal from the averaging circuit and to generate a train of pulses which varies with a voltage of the average signal; and a switch driver circuit which is configured to be responsive to the pulse train from the frequency modulation circuit and to drive a power supply switching circuit with timing to apply a smoothly changing alternating current to the fusing system.

2. A circuit as set forth in claim 1, further comprising an opto-isolator interposed between the timing circuit and the averaging circuit and configured to isolate timing circuit from the voltage of an alternating current supplied by the switch river circuit to the fusing system.

3. A circuit as set forth in claim 1, wherein the timing circuit comprises a circuit which is configured to produce a series of pulses the width of which are varied in accordance with a predetermined control.

4. A circuit as set forth in claim 3, wherein the predetermined control comprises a phase angle control.

5. A circuit as set forth in claim 3, wherein the predetermined control comprises integral half cycle control.

6. A circuit as set forth in claim 3, wherein the predetermined control comprises a hysteresis control wherein the pulse width of each of the pulses corresponds to a predeterrnined length of time.

7. A circuit as set forth in claim 1, wherein a modulation circuit arrangement comprises a pulse width modulation (PWM) circuit which receives a voltage signal output from the averaging circuit and produces a pulse train having a duty cycle which varies with the voltage signal output from the averaging circuit.

8. A circuit as set forth in claim 7, wherein the modulation circuit arrangement comprises a voltage controlled oscillator and resetable monostable multivibrator serially connected to the oscillator.

9. A circuit as set forth in claim 7, wherein the modulation circuit arrangement comprises an oscillator, a ramp generator serially connected to the oscillator and a comparator connected to the averaging circuit and the ramp generator.

10. A circuit as set forth in claim 1, wherein the timing circuit is a phase angle responsive circuit configured to produce pulses having a width corresponding to the time interval between the alternating current reaching maximum and minimum values.

11. A circuit as set forth in claim 1, wherein the timing circuit is an integral half cycle circuit configured to produce pulses the width of which vary with a full cycle and a plurality of half cycle periods of an alternating current cycle.

12. A circuit as set forth in claim 1, wherein the timing circuit is a hysteresis circuit configured to produce pulses having a width corresponding to a predetermined period of time.

13. A circuit as set forth i claim 10, wherein the phase angle responsive circuit comprises:

a set/reset (S/R flip flop circuit comprising:

first an second inverters, wherein the first inverter is configured to receive a gate signal which is produce in accordance with an alternating current that is supplied to the fusing system via the switch driver circuit, assuming a maximum voltage, and wherein the second inverter is configured to receive a zero cross signal when the voltage of the alternating current assumes a minimum value; and first an second NAND logic gates wherein the first NAND logic gate is configure to receive the output of the first inverter and the output of the second NAND logic gate and wherein the second NAND logic gate is configured to receive the output of the second inverter and the output of the first NAND logic gate.

14. A circuit as set forth i claim 10, wherein the phase angle responsive circuit comprises a monostable circuit wherein a trigger and reset terminals respectively receive a gate signal and a zero cross signal, the gate signal being produced in accordance with an alternating current which is supplied to the fusing system via the switch driver circuit, assuming a maximum voltage and he zero cross signal being produced in accordance with the alternating current assumming a minimum voltage.

15. A circuit for controlling the supply of alternating current to a fusing system including a fuser, comprising:

a fuser temperature sensor configured to produce a first output signal representative of the temperature of the fuser;

a temperature set point circuit configured to produce a second output signal representative of the temperature to which the fuser is to be heated;

a control circuit configured to be responsive to the first and second output signals, to monitor the temperature of the fusing system and to generate at least one control signal indicative that power should be supplied to the fuser;

a timing circuit configured to be responsive to the at least one control signal to generate a timing signal which determines the timing with which power should be supplied to the fuser; and an averaging circuit configured to be responsive to the timing signal and to output a signal which gradually increases and decreases and which is used to control delivery of power to the fuser.

16. A circuit as set forth in claim 15, further comprising an opto isolator configured to be connected between the timing circuit and the averaging circuit and to electrically isolate the timing circuit from the averaging circuit.

17. A circuit as set forth in claim 15, further comprising a frequency modulation circuit configured to receive an output from the averaging circuit; and a switch drive circuit configured to be responsive to the frequency modulation circuit and to supply alternating current to the fusing system.

18. A circuit as set forth in claim 17, wherein the frequency modulation circuit comprises a pulse width modulator (PWM) circuit.

19. A circuit as set forth in claim 17, wherein the frequency modulation circuit comprises a voltage controlled oscillator and a serially connected resetable monostable multivibrator.

20. A circuit as set forth in claim 17, wherein the frequency modulation circuit comprises a comparator configured to receive a first input from the averaging circuit and a second input from connected oscillator and ramp generator.

21. A circuit for controlling a fusing system which is configured for connection to a source of alternating current, comprising:

a switch drive circuit for connecting the fusing system with the source of alternating current;

a timing circuit which produces a pulse train; and an averaging circuit responsive to the pulse train from the timing circuit and connected with the switch drive circuit via a frequency modulation circuit.

22. A circuit as set forth in claim 21, wherein the timing circuit comprises a circuit configured to be responsive to a gate signal indicative of the voltage of the alternating current assuming a maximum value and a zero cross signal indicative of the voltage of the alternating current assuming a minimum value.

23. A circuit as set forth in claim 21, wherein the timing circuit is configured to produce integral half cycle signal based on a full wave and a plurality of half waves of the alternating current.

24. A circuit as set forth in claim 21, wherein the timing circuit is configured to produce pulse train wherein the width of the pulse corresponds to a predetermined time period.

* * * * *